US006865921B2

(12) United States Patent
Simonian

(10) Patent No.: US 6,865,921 B2
(45) Date of Patent: Mar. 15, 2005

(54) MATERIAL BENDER

(76) Inventor: Simon Charles Simonian, 2023 W. Tulare Ave., Tulare, CA (US) 93274

( * ) Notice: Subject to any disclaimer, the term of this patent is extended or adjusted under 35 U.S.C. 154(b) by 0 days.

(21) Appl. No.: 10/802,546

(22) Filed: Mar. 16, 2004

(65) Prior Publication Data

US 2004/0182127 A1 Sep. 23, 2004

Related U.S. Application Data

(60) Provisional application No. 60/456,529, filed on Mar. 20, 2003.

(51) Int. Cl.[7] ..... B21K 1/74; B21D 7/022

(52) U.S. Cl. ..... 72/390.4; 72/390.5; 72/389.1

(58) Field of Search ..... 72/458, 389.1, 72/389.2, 389.7, 390.1, 390.2, 390.3, 390.4, 390.5; 59/56

(56) References Cited

U.S. PATENT DOCUMENTS

| | | | | | |
|---|---|---|---|---|---|
| 385,778 | A | * | 7/1888 | Spencer | 72/390.3 |
| 1,054,132 | A | * | 2/1913 | Miner | 72/390.4 |
| 1,964,550 | A | * | 6/1934 | Abramson | 72/389.7 |
| 3,209,577 | A | * | 10/1965 | Teplow | 72/389.6 |
| 3,387,478 | A | | 6/1968 | Burr | |
| 3,874,165 | A | * | 4/1975 | Dawson | 59/56 |
| 4,122,697 | A | | 10/1978 | Hanyo et al. | |
| 4,552,006 | A | | 11/1985 | Yogo | |
| 4,989,441 | A | | 2/1991 | Wagner | |
| 5,515,706 | A | | 5/1996 | Paul | |
| 5,615,572 | A | * | 4/1997 | Johnson et al. | 72/389.1 |
| 6,644,087 | B1 | * | 11/2003 | Ralph et al. | 72/390.4 |

OTHER PUBLICATIONS

Jock Dempsey, "Commercial Benders," Internet, 1988.
"Manufacture of Tube, Pipe, and Profile Bending Equipment," Internet, 2002, CML USA Inc Ercolina.
Chris Ray, "Bending Circles and Arcs with a Hossfeld Bender," Internet, 1999, ArtMetal.
"Hossfeld Universal No. 2 Bender," Internet.
"Hossfeld Pipe & Tube Benders," Internet, Jenness Wood-Kuts Co., Inc.

* cited by examiner

*Primary Examiner*—David Jones
(74) *Attorney, Agent, or Firm*—Richard A. Ryan

(57) ABSTRACT

A material bender for bending a stock material into a desired shape. The material bender has a base plate on which is mounted a die holder that holds a die shaped to provide the desired bend shape, a ram guide configured to provide a ram path for guiding a bending ram that pushes against the stock material, and various upwardly projecting pins configured to support the material as it is bent by the bending ram. In one configuration, the bending ram pushes against the stock material to cause it to bend against the die. In another configuration, the bending ram pushes against the stock material to cause it to bend against one or more of the upwardly projecting pins. The base plate is configured to be mounted on a mounting plate of a mounting apparatus that includes a support frame configured to attach to the hitch of a vehicle.

34 Claims, 5 Drawing Sheets

MATERIAL BENDER

CROSS-REFERENCE TO RELATED APPLICATIONS

This application claims the benefit of U.S. Provisional Application No. 60/456,529 filed Mar. 20, 2003.

BACKGROUND OF THE INVENTION

A. Field of the Invention

The field of the present invention relates generally to devices for bending materials, particularly cold bending of metal materials such as round, rectangular or flat steel stock. More particularly, the present invention relates to such material bending devices that are easily portable and hand operated. Even more particularly the present invention relates to such material benders that are adaptable for mounting to a trailer hitch or like device on the back of a vehicle.

B. Background

Metal materials are utilized as components for many purposes, including products that are configured to have ornamental or decorative aspects, such as metal fences and the like. The metal materials for making the various products generally come in stock form, such as steel tube, bar or sheet stock of various configuration. For instance, stock bars can come in a round, rectangular, square, or other shape of various diameter or thickness. Some of this stock is in a generally flat form. In order to obtain the functional or ornamental configuration, it is often necessary to bend the standard stock materials, also referred to as work objects, into the necessary or desired shape. Both large and small businesses, such as commercial fabrication shops and product-specific shops have a need for cold bending of metal stock.

In general, cold bending is a process of shaping metal into various configurations by bending the stock material without the use of heat. Unlike hot bending, which utilizes heat to "soften" the metal to make it easier to shape, cold bending merely applies a bending force to the metal until the bending force exceeds the material's elastic limit, thereby allowing it to be bent into the desired shape at normal temperatures. Most known cold bending devices utilize various combinations of positioning members to hold the stock material in place, one or more die members to provide the shape(s) around which the stock material is bent and lever-related devices to force the stock material to bend around the die members. Naturally, it is necessary that the machine utilized for bending have components which are stronger than the stock material being bent so that the bending process does not damage the machine instead of bending the stock.

Many material bending machines for cold bending utilize hydraulic and/or electrical components to apply the force necessary to bend the stock into the desired shape. In general, these material bending machines are generally very expensive and require a somewhat significant amount of capital expenditure for the machines, devices associated with operating the machines and the floor space for the machines. Most individuals and small commercial fabrication shops cannot afford the cost for this type of machine. Besides the cost, these machines are generally not configured to be easily moved from one location to another or to be moved to a remote location, such as locations outside the plant, factory or similar fixed location in which they are typically used. In addition, the typical cold bending machine has dies that can be somewhat difficult to change. Another disadvantage of the hydraulically-driven and other non-hand bending machines is that the user of the machine sacrifices his or her ability to "feel" the bending of the stock material. Yet another limitation of hydraulic or other driven material benders is that the person is separate from the material bender and the bending process. It is well known by those skilled in the art of cold bending, that many people like to be able to "feel" the material bending so that they can have more control over the bending process.

Hand bending machines have been in use for many years. One very popular type of hand bending machine is known as the Hossfeld bender. Another hand bending machine for cold bending is the Diacro bender. Although both of these bending machines are very versatile with regard to the types of bending that can be done with the machines, neither machine is configured to be easily transported and used in a field location (i.e., placed in the back of pick-up truck and used at or near where the final product is desired). This is also true of other material benders utilized for cold bending of stock materials. What is needed, therefore, is an improved material bender for cold bending of stock materials that is configured for hand bending, for relatively easy transport and for use in field or remote locations. The preferred material bender should be sized and configured to cold bend different sizes of stock material into various shapes and be easy to change dies in order to obtain those different shapes. Ideally, the material bender should be relatively inexpensive to manufacture, easy to use and adaptable for mounting on or to a vehicle's trailer hitch or like device.

SUMMARY OF THE INVENTION

The material bender of the present invention for cold bending of steel stock and other materials solves the problems and provides the benefits identified above. That is to say, the present invention discloses a new and improved material bender that is easy to use, easy to adapt for different materials and shapes and relatively easy to transport to and used in field or remote locations. The material bender of the present invention is configured for hand bending of steel stock and other materials so as to provide the user with a greater amount of feel of the bending process and, therefore, control over the bending. The material bender of the present invention can be mounted on a trailer hitching apparatus on the back of a standard pick-up truck or other vehicle.

In one aspect of the present invention, the material bender of the present invention includes a base plate having a forming die holder that is mounted thereon in spaced apart relation to a ram guide also mounted on the base plate. The forming die holder is configured to have or receive a forming die with a shaped portion that is configured to provide the desired shape of bend to the stock material. The ram guide, which can comprise a pair of ram guide members attached to the base plate and a top plate mounted on top of the ram guide members, is configured to form a ram path to guide a bending ram against the stock material. The bending ram is sized and configured to move through the ram path. The bending ram has a first end having a tool face configured to apply a shaped force to the stock material and a second end configured to be cooperatively engaged by a generally elongated handle that is in pivotal relation with the base plate. In the preferred embodiment, the handle pivotally attaches to the ram guide between the base plate and the top plate and is configured to drive the bending ram through the ram path and against the stock material. Also in the preferred embodiment, one or more upwardly projecting stationary pins are mounted on the base plate and configured to abut the stock material while the bending ram is driven through the ram path against the stock material. One or more pin receiving bores on the base plate are configured to receive an upwardly projecting adjusting pin configured to abut the stock material while the bending ram applies the shaped force to the stock material. A pin support bar can be mounted to the base plate, via plate support pins on the stationary pins, to support the adjusting pins. The material bender can also comprise a mounting apparatus configured for supporting the base plate while bending the stock material. Preferably, the material bender is portable and the mounting apparatus has a support frame configured for connection to a hitch attached to a vehicle so that it may be used in the field or at remote locations.

Accordingly, the primary objective of the present invention is to provide a material bender for cold bending of stock material that provides the advantages discussed above and that overcomes the disadvantages and limitations associated with presently available material benders.

It is also an object of the present invention to provide a material bender suitable for hand bending stock and other products made from steel and other materials into various desired shapes.

It is also an object of the present invention to provide a material bender that is easily transported, such as on a vehicle's trailer hitch apparatus, and used in field or remote locations to cold bend stock material.

It is also an object of the present invention to provide a material bender that has components that are relatively easy to change for different size materials and different shaped bends.

It is also an object of the present invention to provide a material bender for cold bending of stock material that generally comprises a base plate on which is selectively mounted various pins and/or dies and a hand-operated ram system having a guided ram with a tool face suitable for obtaining the desired shape of bend and a lever mechanism for driving the ram into the stock material to obtain the bend.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiments of the material bender of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein.

Figure 1:
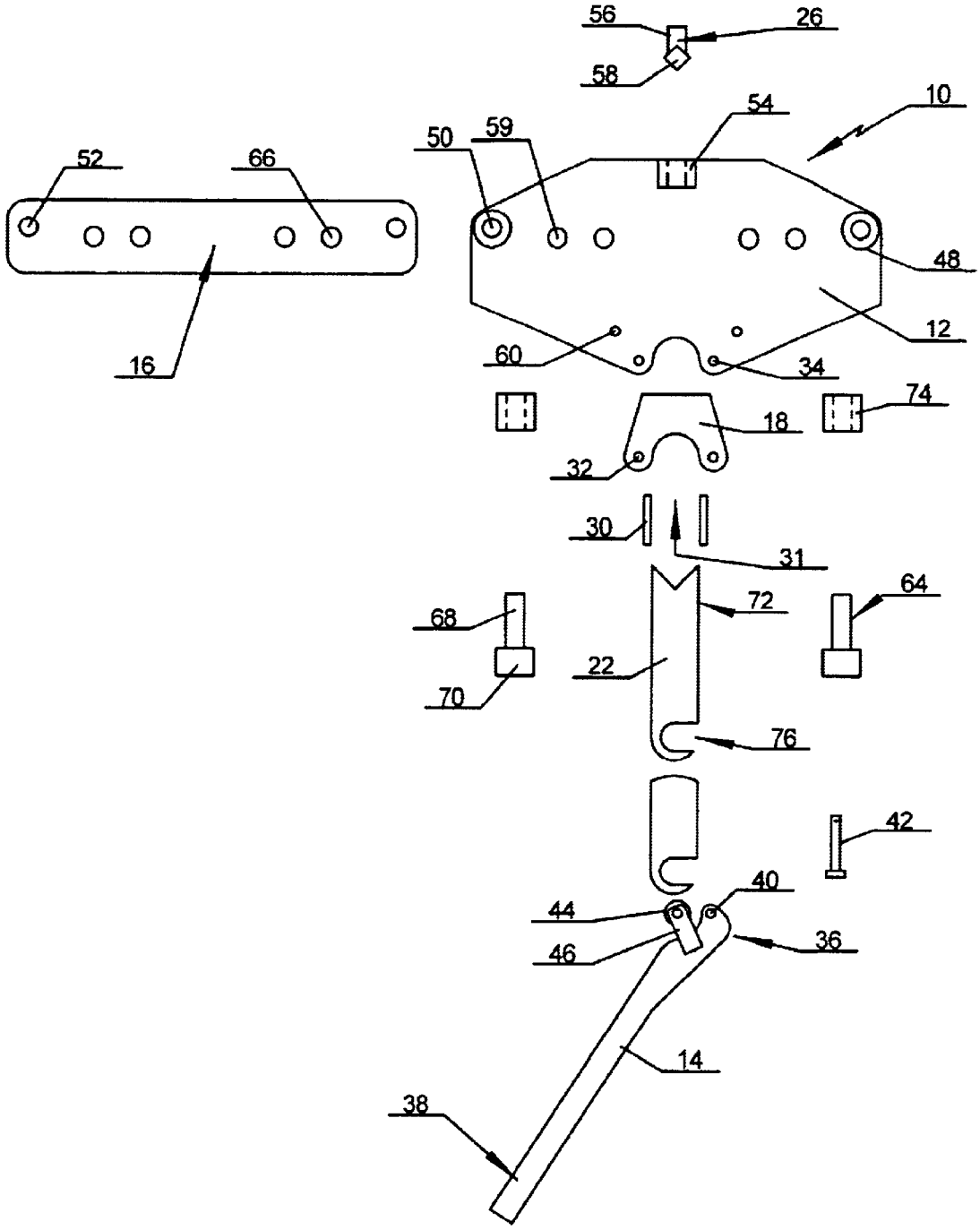
FIG. 1 is an exploded top view of the material bender of the present invention showing use of an angled bending ram and forming die.
Figure 2:
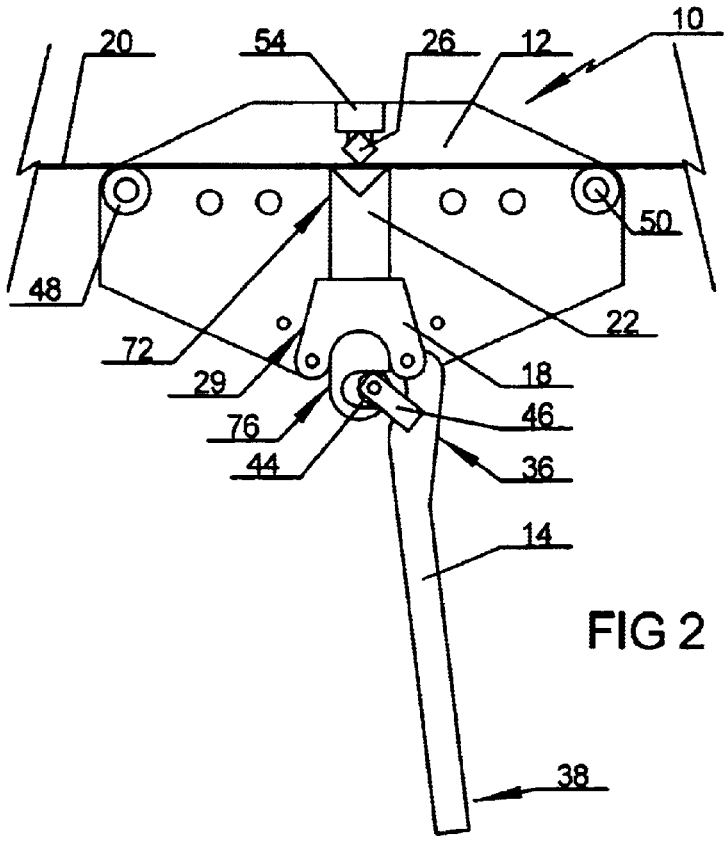
FIG. 2 is a top view of the material bender of the present invention showing stock material positioned in the material bender prior to bending the material into an angled bend.
Figure 3:
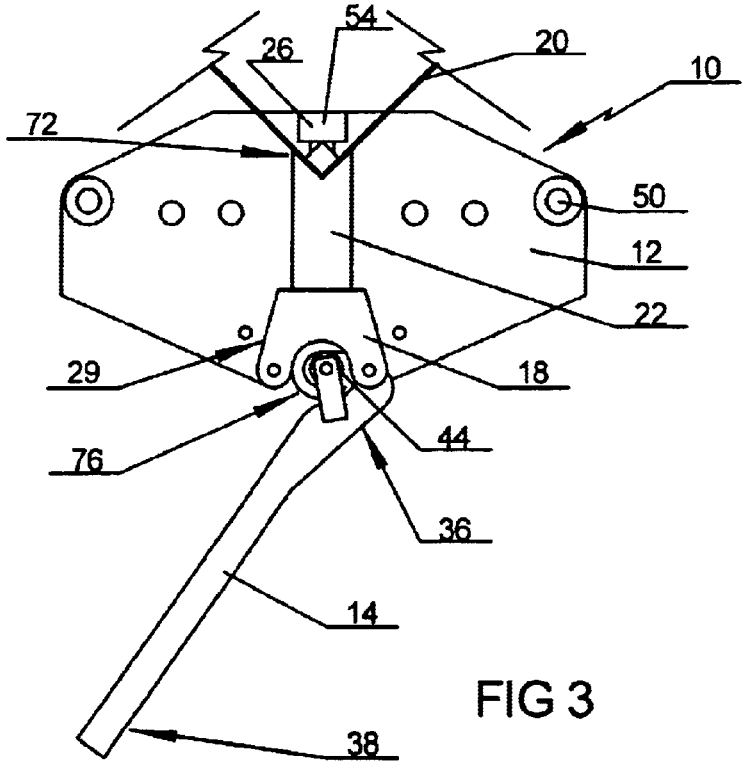
FIG. 3 is the same as FIG. 2 except showing the stock material being bent by the material bender of the present invention.
Figure 4:
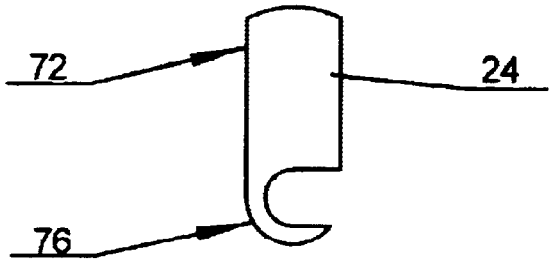
FIG. 4 is top view of an alternative bending ram for use with the material bender of the present invention.
Figure 5:
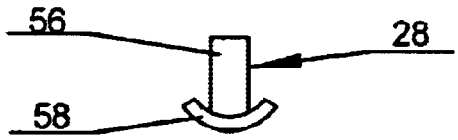
FIG. 5 is top view of an alternative forming die for use with the material bender of the present invention.

In the preferred embodiment of the material bender of the present invention, shown in the figures, the material bender is identified generally as 10. As best shown in the FIG. 1, the preferred material bender 10 primarily comprises base plate 12, handle 14, pin support bar 16 and top plate 18 which operate together to allow a person to bend stock material 20, such as that shown in FIGS. 2–3 and 4–5. As explained in more detail below, the above components work with first bending ram 22 and first forming die 26 to bend stock material 20 into the desired shape, with first bending ram 22 as the tool and first forming die 26 as the anvil, an example of which is shown in FIGS. 1–3. An example of an alternative configuration for the bending ram is shown as 24 in FIG. 4 (shorter and arched tool face) and alternative configuration for the forming die (curved anvil face) is shown as 28 in FIG. 5. In a preferred embodiment, mounted on base plate 12 is ram guide 29, which is formed from ram guide members 30 welded onto base plate 12 and top plate 18 welded onto ram guide members 30 such that ram path 31 for bending rams 22 and 24 is provided between base plate 12 and top plate 18. Preferably, ram guide members 30 are welded between base plate 12 and top plate 18 in spaced apart relation that is substantially equal to the width of the bending rams 22 so the bending rams 22 will move generally straight between ram guide members 30 in ram guide 29, as explained below. Top plate 18 is positioned over base plate 12 such that top plate bores 32 are in substantial alignment with the corresponding base plate bores 34.

Handle 14 has a first end 36 and a second end 38. First end 36 of handle 14 includes a handle bore 40 that, when material bender 10 is assembled according to a preferred embodiment, is in corresponding relationship with one set of top plate bores 32 and base plate bores 34, all of which are sized and configured to receive handle pin 42 to pivotally secure handle 14 to base plate 12. In the preferred embodiment, base plate 12, handle 14 and top plate 18 are configured with bores 34, 40 and 32, respectively, such that handle 14 can be installed for either left or right movement (i.e., clockwise or counterclockwise in the figures). First end 36 of handle 14 has a roller 44 rotatably mounted to roller support 46 to facilitate pivotal movement of handle 14 so as to linearly move bending rams 22 or 24 through ram path 31 of ram guide 29, as described in more detail below. Second end 38 of handle 14 should be sized and configured to be easily grasped by a person's one or two hands so they can pivot handle 14 to bend stock material 20. Handle 14 can be made of various lengths, however, in the preferred embodiment, handle 14 should not be so long as to make it too difficult to transport material bender 10. In one embodiment, handle 14 is made to be adjustable (i.e., telescoping) in length.

As shown in FIGS. 1–3 and 6–7, base plate 12 has a pair of stationary pins 48 that, in the preferred embodiment, are fixedly attached (i.e., by welding or other means) to base plate 12. Stationary pins 48 have plate support pins 50 extending generally upward therefrom that are sized and configured to be received inside of support bores 52 on pin support bar 16, as shown mounted on base plate 12 in FIG. 8. On the side of base plate 12 opposite the location of top plate 18 is a forming die holder 54 for holding forming dies, such as first forming die 26 and second forming die 28, therein. Forming die holder 54 should be configured to receive the insert portion 56 of forming dies 26 and 28 therein so that the user of material bender 10 can select a forming die 26 or 28 that has a shaped portion 58 that provides the desired shape for the bend in stock material 20, such as the angled or arched shapes exemplified in FIGS. 1–3 and 5. As known to those skilled in the art, forming die holder 54 must be securely attached to base plate 12 such that when material bender 10 is used to bend stock material 20, forming die holder 54 will not move relative to base plate 12 and forming die 26 or 28 will not move relative to forming die holder 54. If only a single shape of bend is desired for material bender 10 of the present invention, forming die 26 or 28, as well as other shapes, can be fixed inside die holder 54 or fixed directly to base plate 12. Base plate 12 has one or more pin receiving bores 59 for receiving the adjusting pins described below. Base plate 12 also has one or more mounting bores 60 for securely mounting base plate 12, and therefore material bender 10, to a mounting apparatus 62, such as that shown in FIG. 9. In the preferred embodiment, base plate 12 of material bender 10 is mounted in a generally horizontal configuration.

Figure 6:
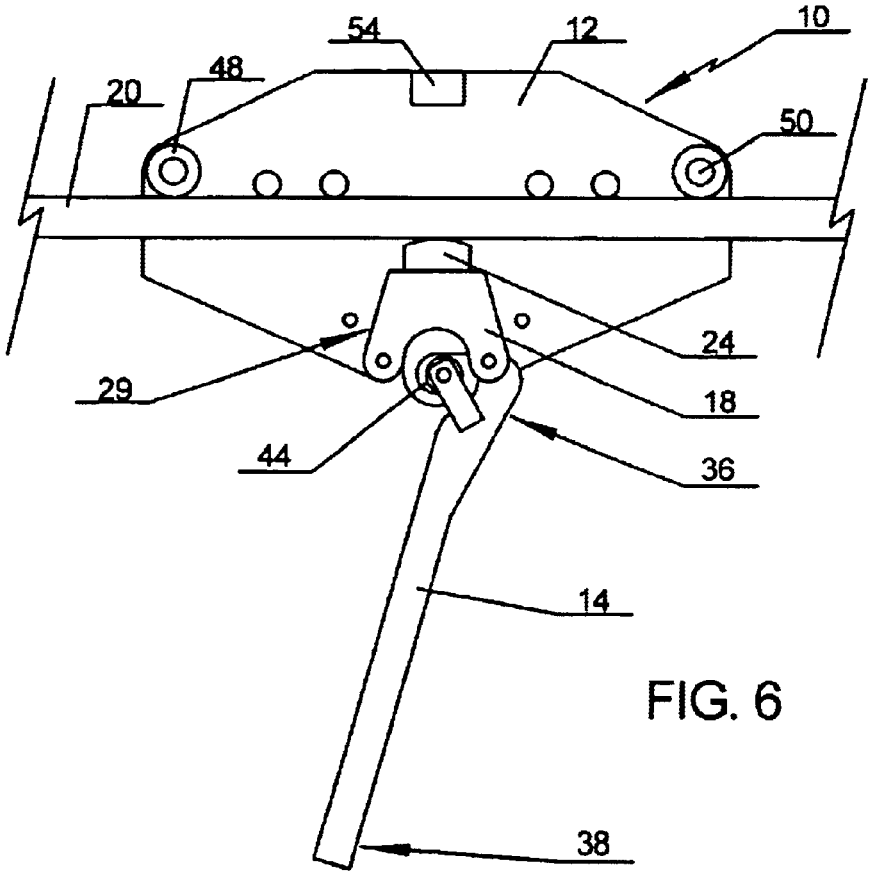
FIG. 6 is a top view of the material bender of the present invention showing stock material positioned in the material bender prior to bending the material into a radial bend.
Figure 7:
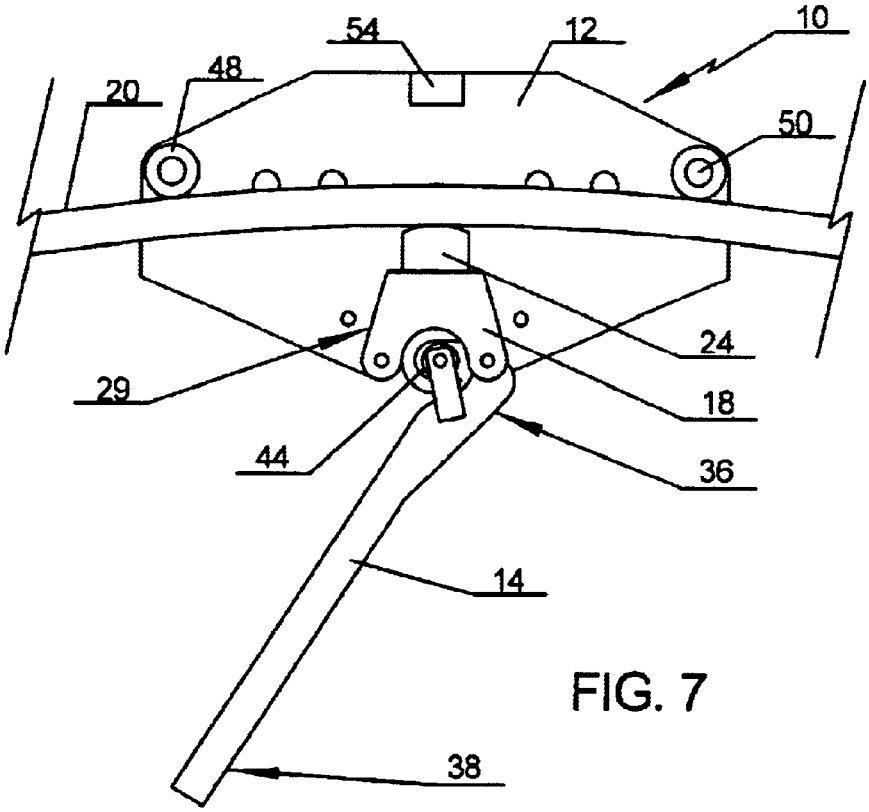
FIG. 7 is the same as FIG. 6 except showing the stock material being bent by the material bender of the present invention.
Figure 8:
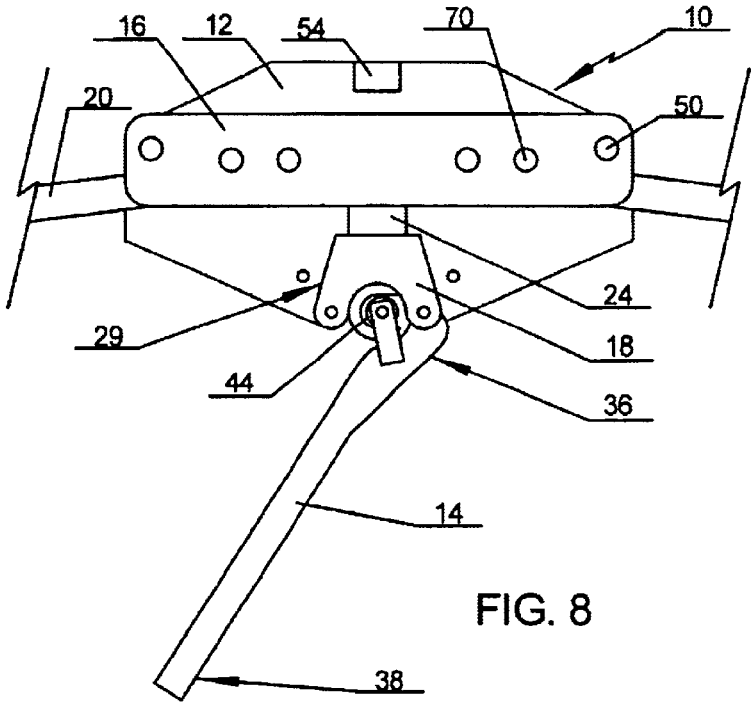
FIG. 8 is a top view of the material bender of the present invention showing the pin support bar placed on top of the base plate.

In use, as explained below and shown in FIG. 8, support bores 52 of pin support bar 16 are placed over plate support pins 50 on stationary pins 48. One or more adjusting pins 64 (generally, they will be used in pairs), are placed into pin bores 66 on pin support bar 16 and into pin receiving bores 59 such that pin portion 68 of adjusting pins 64 extends between pin support bar 16 and base plate 12 (i.e., pin bores 66 and pin receiving bores 59) with the base portion 70 of adjusting pins 64 extending above pin support bar 16. As shown in FIGS. 6 and 7 (shown without pin support bar 16 mounted thereon), stock material 20 can be placed between one or more adjusting pins 64 and/or stationary pins 48 to provide a more "gentle" bend in stock material 20. As known to those skilled in the art, use of one or more adjusting pins 64 in pin bores 66 will alter the shape of the final bent product. In FIGS. 6 and 7, first end 72 (i.e., the tool face) of bending ram 24 is pushed against stock material 20 by the radial movement of handle 14, causing stock material 20 to be held against adjusting pins 64 and/or stationary pins 48. Because pins 48 and 64 will not move, stock material 20 will bend (as shown in FIG. 7). If desired, one or more pin shims 74, shown in FIG. 1, can be utilized around the pin portion 68 of adjusting pins 64 between pin support plate 16 and base plate 12 to change the shape of bent stock material 20. The stationary pins 48 and adjusting pins 64 or shims 74 can be configured such that the outer edges thereof can be positioned in the same plane to provide a level surface across base plate 12 against which stock material 20 can be pushed to achieve the desired bending shape.

Bending rams 22 and 24 are configured to slide in and out of ram path 31 of ram guide 29 between base plate 12 and top plate 18, as formed by ram guide members 30, and push against stock material 20 so as to cause it to bend. The appropriate bending ram 22 or 24 is selected depending on which portion of material bender 10 is to be utilized to bend stock material 20. As explained in more detail below, if stock material 20 is to be bent against forming die 26 or 28, then first bending ram 22, the longer of the two shown in the figures, is used so that first end 72 thereof can push against stock material 20 from one side while forming die 26 or 28 remains in place on the opposite side (i.e., like an anvil). If stock material 20 is to be bent against stationary pins 48 and/or removable pins 64 placed in base plate 12, then second bending ram 24, the shorter of the two shown in the figures, is used so that first end 72 thereof will push against one side of stock material 20 to cause it to bend against stationary pins 48 and/or removable pins 64. Second end 76 of bending rams 22 and 24 are shaped and configured to cooperatively receive roller 44 and to be slid into and out of ram path 31 between top plate 18 and base plate 12. As readily ascertainable by one skilled in the art, the length of bending ram 22 and 24 affects the depth of travel that bending ram 22 or 24 will move, which changes the radius of the bend of stock material 20. In addition, it is also readily ascertainable by those skilled in the art that the amount of force placed against handle 14 by the user will affect the amount of travel for bending ram 22 or 24 and, consequently, the amount of bend available to be assessed against stock material 20.

Figure 9:
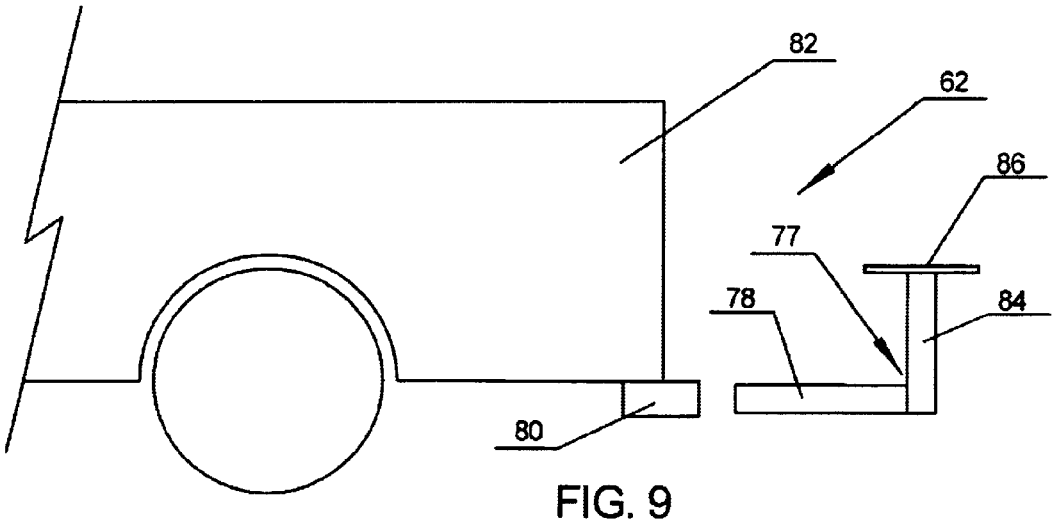
FIG. 9 shows a mounting device for mounting the material bender of the present invention to a trailer hitch on the back of a vehicle.

In a preferred embodiment of the present invention, material bender 10 is configured to be portable and removably mount to mounting apparatus 62, such as that shown in FIG. 9, having support frame 77. In this configuration, support frame 77 of mounting apparatus 62 has a substantially horizontal insert member 78, which is configured to be inserted into and secured to (i.e., by a conventional trailer hitch receiving mechanism) trailer hitch 80 mounted to vehicle 82, such as a standard pick-up truck, and a substantially upright member 84 attached to horizontal insert member 78. In the preferred embodiment, the components of support frame 77 are sized and configured to place material bender 10 at or near a level that is comfortable for the user to reach while standing on the ground behind vehicle 82. Support frame 77 supports mounting plate 86 at the upper end of upright member 84. Mounting plate 86 is configured for removably mounting, in the preferred embodiment, material bender 10 thereto by utilizing one or more connectors (not shown), such as bolts, screws and the like, through mounting bores 60 in base plate 12. Naturally, material bender 10 of the present invention can be mounted, whether removably or not, to other devices and/or structures, including tables, walls and posts and selectively moved from one support to another.

In use, the various components of material bender 10 can be made such that they are easily disassembled for shipping, transport and storage. For instance, in one configuration the components of material bender 10 can be sized and configured such that they will fit into a two foot by two foot box weighing approximately sixty pounds. To utilize material bender 10, the user first assembles material bender 10 by attaching mounting apparatus 62 to vehicle 82 by inserting insert portion 78 into hitch 80 and securing it thereto and then mounting base plate 12 to mounting plate 86 by securing it with one or more screws, bolts or other connectors. The user then determines whether he or she will be bending stock material 20 against a forming die, such as first forming die 26 (as shown in FIGS. 2 and 3) or second forming die 28, for material to be bent the "easy" way (i.e., bent against its narrow side as shown) or to be bent against either the stationary pins 48 and/or adjusting pins 64 to bend the "hard" way (i.e., bent against its thicker side as shown in FIGS. 6 and 7).

If the narrow side of stock material 20 is to be bent, as shown in FIGS. 2 and 3, the user selects the appropriate forming die for the desired bend, such as first forming die 26 for an angle or second forming die 28 for a radial bend, and inserts the selected forming die 26 or 28 into die holder 54 with the shaped portion 58 directed toward top plate 18. For this type of bending, the user would select first bending ram 22 and insert it into ram guide 29 between ram guide members 30 in ram path 31 between top plate 18 and base plate 12 and then attach handle 14 to base plate 10 by inserting roller 44 into the shaped second end 76 of bending ram 22 and inserting handle pin 42 through bores 32, 40 and 34 in top plate 18, handle 14 and base plate 12, respectively. The stock material 20 to be bent is placed on the forming die holder 54 side of stationary pins 48 and/or adjusting pins 64, as shown in FIG. 2. Pivotal movement of handle 14 will cause bending ram 22 to move toward stock material 20 and push against it. The shaped portion 58 of forming die 26 or 28 will cause stock material 20 to bend, as best shown in FIG. 3, into the desired shape.

If the thicker side of stock material 20 is to be bent, as shown in FIGS. 6 and 7, the user will not be using forming die 26 or 28 (or other forming dies). Instead, the user selects second bending ram 24 having the appropriate bend shape, such as the curved shape shown or other shapes, at its first end 72 and inserts bending ram 24 in ram guide 29 between ram guide members 30 into ram path 31 between top plate 18 and base plate 12. As above, handle 14 attaches to base plate 10 by inserting roller 44 into the second end 76 of bending ram 24 and handle pin 42 through bores 32, 40 and 34 in top plate 18, handle 14 and base plate 12, respectively. The stock material 20 to be bent is placed on the base plate 18 side of stationary pins 48, as shown in FIG. 6. If adjusting pins 64 are to be used, either to work in conjunction with stationary pins 48 or not, then pin support bar 16 is placed on stationary pins 48 by placing support bores 52 over plate support pins 50 such that pin support bar 64 is above stock material 20. The user then inserts pin portion 68 of one or more adjusting pins 64 into pin bores 66 and pin receiving bores 59. If desired, pin shims 74 can be used. Pivotal movement of handle 14 will cause bending ram 24 to move toward stock material 20 and push against it. The position of stationary pins 48 and/or adjusting pins 64 (or pin shims 74) will cause stock material 20 to bend, as best shown in FIG. 7.

Figure 10:
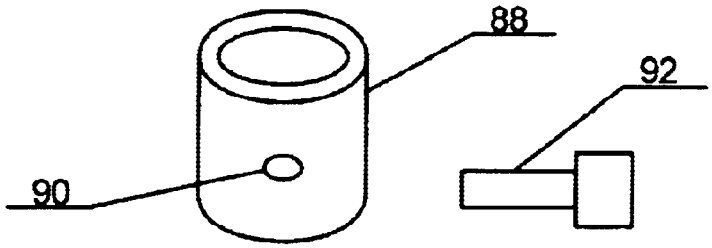
FIG. 10 shows a tubular member configured to be used in place of a forming die on the material bender of the present invention.

In an alternative embodiment of the present invention, a cylindrical portion of pipe or other tubular member 88, shown in FIG. 10, can be utilized as a forming die for the material bender 10 of the present invention. In this embodiment, center opening of tubular member 88 is placed over forming die holder 54 to act as the anvil portion of material bender 10 so as to form the shape of bend desired for stock material 20, as shown with the angled forming die 26 in FIGS. 2 and 3, instead of using the forming dies shown as 26 or 28 which are received inside forming die holder 54. For instance, a section of generally round cylindrical pipe 88 can be positioned over forming die holder 54 to provide a curved surface for stock material 20 to obtain a radial bend. Tubular member 88 of other cross-sectional shapes can also be utilized to provide bends of other shapes for stock material 20. A hole or other opening 90 can be placed in the tubular material so that pin 92 can be inserted through the hole and into forming die holder 54 to hold tubular member 88 in place, with the surface opposite pin 92 being the shaped portion 58. Alternatively, tubular member 88 can be sized and configured to fit tightly over forming die holder 54 such that it is frictionally held in place. In certain circumstances, use of tubular member 88 will be preferred to do the cost or availability of having a shaped forming die 26 or 28.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to assembly, materials, size, shape and use. For instance, some of the components described above can be made integral with each other to reduce the number of separate components.

What is claimed is:

1. A material bender for bending a stock material, comprising:

a base plate having a forming die holder mounted thereon in spaced apart relation to a ram guide mounted on said base plate, said forming die holder having a forming die with a shaped portion, said ram guide comprising a pair of ram guide members attached to said base plate in spaced apart relation and a top plate mounted on said pair of ram guide members to form a ram path between said base plate, said top plate and said pair of ram guide members, said bending ram configured to slide between said pair of ram guide members;

a bending ram configured to move through said ram path, said bending ram having a first end and a second end, said first end configured to apply a shaped force to the stock material; and a generally elongated handle in pivotal relation with said base plate and configured to cooperatively engage said second end of said bending ram to drive said bending ram through said ram path and against said stock material.

2. The material bender according to claim 1, wherein said top plate has a top plate bore, said base plate has a base plate bore and said handle has a handle bore, said top plate bore, said base plate bore and said handle bore in cooperative alignment with one another to receive a handle pin therethrough for pivotal motion of said handle to drive said bending ram through said ram path and against the stock material.

3. The material bender according to claim 1, wherein said forming die holder is configured to removably hold said forming die.

4. The material bender according to claim 1, wherein said base plate further comprises one or more stationary pins mounted thereon, said stationary pins configured to abut the stock material while said bending ram is driven through said ram path against said stock material.

5. The material bender according to claim 1, wherein said base plate further comprises one or more pin receiving bores configured for receiving one or more adjusting pins therein, said adjusting pins configured to abut the stock material and while said bending ram is driven through said ram path against said stock material.

6. The material bender according to claim 5 further comprising a pin support bar configured to be removably mounted on said base plate, said pin support bar having one or more pin bores in corresponding alignment with said one or more pin receiving bores on said base plate, one of said one or more adjusting pins configured to be received through one of said one or more pin bores and one of said one or more pin receiving bores in corresponding alignment therewith.

7. The material bender according to claim 6, wherein said pin support bar is removably mounted on one or more plate support pins mounted on said base plate.

8. The material bender according to claim 1, wherein said handle comprises a roller configured to cooperatively engage said second end of said bending ram.

9. The material bender according to claim 1, wherein said material bender is configured to be portable and said base plate is adaptable for attachment to a mounting apparatus.

10. The material bender according to claim 9, wherein said mounting apparatus comprises a support frame configured for supporting said base plate while bending said stock material.

11. The material bender according to claim 10, wherein said support frame is configured for connection to a hitch attached to a vehicle.

12. The material bender according to claim 11, wherein said mounting apparatus comprises a mounting plate for supporting said base plate and said support frame comprises a generally horizontal member configured to attach to said hitch and a generally elongated upright member interconnecting said generally horizontal member and said mounting plate.

13. A material bender for bending a stock material, comprising:

a base plate having a forming die holder mounted thereon in spaced apart relation to a ram guide mounted on said base plate, said forming die holder having a forming die with a shaped portion, said ram guide comprising a pair of ram guide members attached to said base plate in spaced apart relation and a top plate mounted on said pair of ram guide members to form a ram path between said base plate, said top plate and said pair of ram guide members;

a bending ram configured to slidably move through said ram path, said bending ram having a first end configured to apply a shaped force to the stock material and a second end shaped and configured to drive said bending ram through said ram path;

one or more pin receiving bores on said base plate, each of said one or more pin receiving bores configured to receive an upwardly projecting pin configured to abut the stock material while said bending ram applies said shaped force to the stock material; and a generally elongated handle pivotally attached to said ram guide and configured to cooperatively engage said second end of said bending ram to drive said bending ram through said ram path and against said stock material.

14. The material bender according to claim 13 further comprising a pin support bar mounted on said base plate, said upwardly projecting pin interconnecting a pin bore on said pin support bar with one of said one or more pin receiving bores on said base plate.

15. The material bender according to claim 13, wherein said base plate further comprises one or more stationary pins mounted thereon, said stationary pins configured to abut the stock material while said bending ram is driven through said ram path against said stock material.

16. The material bender according to claim 13, wherein said material bender is configured to be portable and said base plate is adaptable for attachment to a mounting apparatus, said mounting apparatus comprising a support frame configured for supporting said base plate while bending said stock material.

17. The material bender according to claim 16, wherein said support frame is configured for connection to a hitch attached to a vehicle.

18. The material bender according to claim 13, wherein said top plate has a top plate bore, said base plate has a base plate bore and said handle has a handle bore, said top plate bore, said base plate bore and said handle bore in cooperative alignment with one another to receive a handle pin therethrough for pivotal motion of said handle to drive said bending ram through said ram path and against the stock material.

19. The material bender according to claim 18, wherein said handle comprises a roller configured to cooperatively engage said second end of said bending ram.

20. The material bender according to claim 13, wherein said handle comprises a roller configured to cooperatively engage said second end of said bending ram.

21. A material bender for bending a stock material, comprising:

a base plate having a forming die holder mounted thereon in spaced apart relation to a ram guide mounted on said base plate, said forming die holder having a forming die with a shaped portion, said ram guide configured to form a ram path therein;

a bending ram configured to move through said ram path, said bending ram having a first end and a second end, said first end configured to apply a shaped force to the stock material;

one or more upwardly projecting stationary pins mounted on said base plate, said stationary pins configured to abut the stock material while said bending ram is driven through said ram path against said stock material;

one or more pin receiving bores on said base plate, each of said one or more pin receiving bores configured to receive an upwardly projecting adjusting pin configured to abut the stock material while said bending ram applies said shaped force to the stock material;

a generally elongated handle in pivotal relation with said base plate and configured to cooperatively engage said second end of said bending ram to drive said bending ram through said ram path and against said stock material; and a mounting apparatus comprising a support frame configured for supporting said base plate while bending said stock material, said support frame configured for connection to a hitch attached to a vehicle.

22. The material bender according to claim 21, wherein said ram guide comprises a pair of ram guide members attached to said base plate in spaced apart relation and a top plate mounted on said pair of ram guide members to form said ram path therebetween, said bending ram configured to slide between said pair of ram guide members.

23. The material bender according to claim 22, wherein said top plate has a top plate bore, said base plate has a base plate bore and said handle has a handle bore, said top plate bore, said base plate bore and said handle bore in cooperative alignment with one another to receive a handle pin therethrough for pivotal motion of said handle to drive said bending ram through said ram path and against the stock material.

24. The material bender according to claim 23, wherein said handle comprises a roller configured to cooperatively engage said second end of said bending ram.

25. The material bender according to claim 21, wherein said handle comprises a roller configured to cooperatively engage said second end of said bending ram.

26. The material bender according to claim 21, wherein said mounting apparatus comprises a mounting plate for supporting said base plate and said support frame comprises a generally horizontal member configured to attach to said hitch and a generally elongated upright member interconnecting said generally horizontal member and said mounting plate.

27. The material bender according to claim 21 further comprising a pin support bar mounted on said base plate, said upwardly projecting adjusting pin interconnecting a pin bore on said pin support bar with one of said one or more pin receiving bores on said base plate.

28. A material bender for bending a stock material, comprising:

a base plate having a forming die holder mounted thereon in spaced apart relation to a ram guide mounted on said base plate, said forming die holder having a forming die with a shaped portion, said ram guide configured to form a ram path therein;

a bending ram configured to move through said ram path, said bending ram having a first end and a second end, said first end configured to apply a shaped force to the stock material; and a generally elongated handle in pivotal relation with said base plate and configured to cooperatively engage said second end of said bending ram to drive said bending ram through said ram path and against said stock material, said handle having a roller configured to cooperatively engage said second end of said bending ram.

29. The material bender according to claim 28, wherein said ram guide comprises a pair of ram guide members attached to said base plate in spaced apart relation and a top plate mounted on said pair of ram guide members to form said ram path therebetween, said bending ram configured to slide between said pair of ram guide members, said top plate having a top plate bore, said base plate having a base plate bore, said handle having a handle bore, said top plate bore, said base plate bore and said handle bore in cooperative alignment with one another to receive a handle pin therethrough for pivotal motion of said handle to drive said bending ram through said ram path and against the stock material.

30. A portable material bender for bending a stock material, comprising:

a base plate having a forming die holder mounted thereon in spaced apart relation to a ram guide mounted on said base plate, said forming die holder having a forming die with a shaped portion, said ram guide configured to form a ram path therein;

a bending ram configured to move through said ram path, said bending ram having a first end and a second end, said first end configured to apply a shaped force to the stock material;

a generally elongated handle in pivotal relation with said base plate and configured to cooperatively engage said second end of said bending ram to drive said bending ram through said ram path and against said stock material; and a mounting apparatus having a support frame configured for supporting said base plate while bending said stock material, said base plate adaptable for attachment to said mounting apparatus, said support frame configured for connection to a hitch attached to a vehicle.

31. The portable material bender according to claim 30, wherein said mounting apparatus comprises a mounting plate for supporting said base plate and said support frame comprises a generally horizontal member configured to attach to said hitch and a generally elongated upright member interconnecting said generally horizontal member and said mounting plate.

32. The portable material bender according to claim 30, wherein said ram guide comprises a pair of ram guide members attached to said base plate in spaced apart relation and a top plate mounted on said pair of ram guide members to form said ram path therebetween, said bending ram configured to slide between said pair of ram guide members, said top plate having a top plate bore, said base plate having a base plate bore, said handle having a handle bore, said top plate bore, said base plate bore and said handle bore in cooperative alignment with one another to receive a handle pin therethrough for pivotal motion of said handle to drive said bending ram through said ram path and against the stock material.

33. The portable material bender according to claim 32, wherein said handle comprises a roller configured to cooperatively engage said second end of said bending ram.

34. The portable material bender according to claim 30, wherein said handle comprises a roller configured to cooperatively engage said second end of said bending ram.

* * * * *